US010946538B2

(12) United States Patent
Wind

(10) Patent No.: US 10,946,538 B2
(45) Date of Patent: Mar. 16, 2021

(54) COUPLING STRUCTURE FOR A PERSONAL CARE DEVICE

(71) Applicant: KONINKLIJKE PHILIPS N.V., Eindhoven (NL)

(72) Inventor: Liesbet Hillechina Wind, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 423 days.

(21) Appl. No.: 14/892,633

(22) PCT Filed: May 21, 2014

(86) PCT No.: PCT/EP2014/060388

§ 371 (c)(1),
(2) Date: Nov. 20, 2015

(87) PCT Pub. No.: WO2014/191265

PCT Pub. Date: Dec. 4, 2014

(65) Prior Publication Data

US 2016/0101529 A1 Apr. 14, 2016

(30) Foreign Application Priority Data

May 30, 2013 (EP) ..... 13169894

(51) Int. Cl.
*B26B 19/38* (2006.01)
*B26B 21/40* (2006.01)

(52) U.S. Cl.
CPC ..... *B26B 19/386* (2013.01); *B26B 19/3813* (2013.01); *B26B 21/40* (2013.01)

(58) Field of Classification Search
CPC ..... B26B 19/145; B26B 19/146; B26B 19/28; B26B 21/521; B26B 19/38;
(Continued)

(56) References Cited

U.S. PATENT DOCUMENTS 3,568,313 A 3/1971 Hutter
6,378,210 B1 4/2002 Bickford
(Continued)

FOREIGN PATENT DOCUMENTS

CN 202144076 U 2/2012
CN 2022292818 U 7/2012
WO 2010034175 A1 4/2010

*Primary Examiner* — Jason Daniel Prone
*Assistant Examiner* — Samuel A Davies

(57) ABSTRACT

A personal care device like a shaving device (1) comprises a base structure (2) and a head structure (3). The head structure comprises a first coupling element (5) and at least a head support structure (4) configured to hold at least one treatment head (4'). The base structure comprises a second coupling element (6). The coupling elements can releasably be coupled to each other for coupling the head structure to the base structure. By rotating the coupled coupling elements with respect to each other in a first rotational direction about a central axis (9), a first inclined surface (15) of at least one of the first and second coupling elements cooperates with a first co-operating surface (26) of the other of the first and second coupling elements thereby driving the first and second coupling elements away from each other in an axial direction extending parallel to the central axis.

19 Claims, 7 Drawing Sheets

(58) Field of Classification Search
CPC ..... Y10T 403/7007; Y10T 403/7009; Y10T 403/776; B26D 19/14; B26D 19/3813
USPC ... 403/348, 349, 41, 42, 328, 332, 235, 277, 403/409.1, 204
See application file for complete search history.

(56) References Cited

U.S. PATENT DOCUMENTS

| | | | | |
|---|---|---|---|---|
| 8,261,452 | B2 * | 9/2012 | Westerhof | B26B 19/14 30/43.4 |
| 8,381,405 | B2 | 2/2013 | Shigeta | |
| 8,732,964 | B2 * | 5/2014 | Fischer | B26B 19/06 30/34.1 |
| 2010/0299927 | A1 | 12/2010 | Fischer | |
| 2011/0030220 | A1 | 2/2011 | Shimizu | |

* cited by examiner

COUPLING STRUCTURE FOR A PERSONAL CARE DEVICE

This application is the U.S. National Phase application under 35 U.S.C. § 371 of International Application No. PCT/EP2014/060388, filed on May 21, 2014, which claims the benefit of European Application No. 13169894.6 filed on May 30, 2013. These applications are hereby incorporated by reference herein.

FIELD OF THE INVENTION

The invention relates to a personal care device like a shaving device comprising a base structure and a head structure, wherein the head structure comprises a first coupling element and at least a head support structure configured to hold at least one treatment head, whilst the base structure comprises a second coupling element, which coupling elements can releasably be coupled to each other for coupling the head structure to the base structure.

The invention also relates to a head structure and a base structure for such personal care device as well as to a coupling structure.

BACKGROUND OF THE INVENTION

EP2086729B1 discloses a shaving device comprising a head structure and a base structure. The head structure comprises a head support structure configured to hold at least one shaving head. The head structure also comprises a coupling element arranged in a central area of the head structure. The base structure comprises a retaining structure configured for releasably retaining the coupling element for coupling the head structure to the base structure.

The coupling element is substantially cylindrical and is kept in a retaining recess of the retaining structure by means of a spring element. The spring element abuts against a sloped surface of the coupling element. When a relatively large load, i.e. force or torque, is applied to the head structure e.g. due to an accidental misuse or fall of the shaving device, the spring element will shift off the sloped surface of the coupling element and the head structure will be released from the base structure.

The cylindrical coupling element extends along a central axis. The spring element will only shift off the sloped surface of the coupling element, if a force is applied on the coupling element parallel to the central axis and away from the retaining structure or a torque is applied about an axis extending perpendicular to the central axis.

When a relatively large torque in a rotational direction along the central axis is applied between the coupling element and the retaining structure, the spring element will not shift off the sloped surface of the coupling element, the coupling element will not be disconnected from the retaining structure, and there is a risk that the head structure and base structure might get damaged.

U.S. Pat. No. 6,378,210 B1 discloses a personal care device comprising a base unit with external threads and a shaver attachment housing with internal shaver attachment threads that are companionate with the base unit threads. The shaver attachment housing can be screwed on the base unit by rotating the shaver attachment housing in a first direction with respect to the base unit, and can be unscrewed from the base unit by rotating the shaver attachment housing in a second opposite direction with respect to the base unit.

In the personal care device known from U.S. Pat. No. 6,378,210 B1, only by a rotation in the second direction the shaver attachment housing will be moved away from the base unit. When a relatively large torque in the first rotational direction along the central axis is applied between the shaver attachment housing and the base unit, the shaver attachment housing will be moved towards the base unit so that the shaver attachment housing will not be disconnected from the base unit, whereby the shaver attachment housing and the base unit might get damaged.

U.S. Pat. No. 3,568,313 discloses an electric shaver comprising a main housing accommodating a shaving unit and a battery compartment, which is coupled to the main housing by means of a bayonet catch including two oppositely disposed pins on the main housing co-operating with two oppositely disposed slots in the battery compartment. The battery compartment can be released from the main housing by rotation of the battery compartment relative to the housing in a prescribed direction so as to release the bayonet catch.

SUMMARY OF THE INVENTION

In view of the above, a general object of the present invention is to provide a personal care device wherein the head structure will be easily released from the base structure when a torque about the central axis is applied between the head structure and the base structure.

According to a first aspect, the invention provides a personal care device of the kind mentioned in the opening paragraph, wherein by rotating the coupled coupling elements with respect to each other in a first rotational direction about a central axis a first inclined surface of at least one of the first and second coupling elements cooperates with a first co-operating surface of the other of the first and second coupling elements thereby driving the first and second coupling elements away from each other in an axial direction extending parallel to the central axis, and wherein by rotating the coupled coupling elements with respect to each other in a second rotational direction about the central axis, opposite to the first rotational direction, a second inclined surface of at least one of the first and second coupling elements cooperates with a second co-operating surface of the other of the first and second coupling elements thereby driving the first and second coupling elements away from each other in said axial direction, wherein the first and second inclined surfaces each include an obtuse angle with a tangential direction extending tangentially to the central axis, and wherein the first and second inclined surfaces are inclined in opposite directions relative to said tangential direction.

When rotating the coupling elements about the central axis, the first and second inclined surfaces will at least be moved in the tangential direction and, depending on the rotational direction, one of the first and second inclined surfaces will slide over the respective one of the first and second co-operating surfaces in the axial direction.

Due to the first and second inclined surfaces, the coupling elements will easily be driven away from each other in the axial direction, whereby the coupling between the coupling elements will be released.

Since there are at least two inclined surfaces on preferably each coupling element inclined in opposite directions relative to the tangential direction, the coupling elements will be driven apart and be released from each other by applying a torque in either a clockwise direction or a counter-clockwise direction about the central axis.

If the user wants to release the coupling elements, for example to be able to clean the head structure, he may apply a torque on purpose to cause to drive away the first and second coupling elements from each other and to cause a relative axial movement of the coupling elements. Due to the axial movement the user will have a tactile and visual feedback that the torque is sufficient for releasing the coupling elements.

The size of the obtuse angle will be one of the parameters defining the relation between the size of the torque and the amount of the corresponding displacement in axial direction. The obtuse angles included by the first and second inclined surfaces with the tangential direction may be equal or may be different from each other.

The user can apply the torque in a clockwise direction or in a counter-clockwise direction, whereby in both cases the coupling elements will be moved away from each other.

In an embodiment of the personal care device according to the invention, the first and second co-operating surfaces of the other of the first and second coupling elements cooperating with the first and second inclined surfaces are also inclined.

Since the inclined surfaces as well as the co-operating surfaces are inclined, the inclined surfaces and the respective co-operating surfaces can easily slide over each other.

In a further embodiment of the personal care device according to the invention, the first and second inclined surfaces and the first and second co-operating surfaces have corresponding inclinations.

By having corresponding inclinations, the inclined surfaces and the respective co-operating surfaces will abut against each other over a large contact area. As a result, the forces due to the relative rotation movement about the central axis will be divided over said large contact area, so that wear of the surfaces can be limited.

In a further embodiment of the personal care device according to the invention, the first and second inclined surfaces each include a further obtuse angle with a radial direction extending radially to the central axis.

In this embodiment the first and second inclined surfaces each include an obtuse angle with the tangential direction and a further obtuse angle with the radial direction. The obtuse angle and the further obtuse angle may be equal or different. In an example of this embodiment, the inclined surfaces are straight longitudinal surfaces extending tangentially with respect to a reference plane extending in a reference radial direction to the central axis. Seen in said reference plane the inclined surfaces only include an obtuse angle with the reference radial direction. At a distance from said reference plane and at both sides thereof, however, the inclined surfaces extend obliqueally with respect to a local radial direction. As a result, in these locations the inclined surfaces also include an obtuse angle with respect to a local tangential direction. Such inclined surfaces can easily be manufactured. The inclined surfaces may extend over a certain distance in a direction perpendicular to the radial direction. Such inclined surfaces will also be an external orientation cue for a user supporting the user when coupling the coupling elements to each other. When the inclined surfaces extend relatively far from the central axis, the forces, friction and wear on the inclined surfaces will be relatively low and it will provide more easily rotational stability.

In a further embodiment of the personal care device according to the invention, the head structure, when coupled to the base structure, is solely supported by the coupling elements.

In this embodiment there is no other supporting element between the head structure and the base structure. The head structure is enabled to move and transfer an external load to the coupling element and is thus enabled to enforce the release of the coupling element of the head structure from the coupling element of the base structure.

In a further embodiment of the personal care device according to the invention, the first coupling element and the second coupling element are configured to arrive from an uncoupled state into a coupled state relative to each other by driving the first and second coupling elements towards each other in a coupling direction opposite to the axial direction, and to arrive from the coupled state into the uncoupled state by driving the first and second coupling elements away from each other in the axial direction.

Since the first and second coupling elements are configured in this manner, the coupled coupling elements can be brought from the coupled state into the uncoupled state by driving the coupled coupling elements away from each other in the axial direction along the central axis. Due to the presence of the inclined surfaces and the co-operating surfaces, this can easily be accomplished by rotating the coupled coupling elements with respect to each other about the central axis in either the first or the second rotational direction.

In a further embodiment of the personal care device according to the invention, one of the first and second coupling elements comprises at least one protrusion cooperating with at least one complementary recess in the other of the first and second coupling elements, wherein the coupling elements can be coupled to each other only if the protrusion is located in the recess.

The combination of the protrusion and the recess defines a preferred and desired orientation of the coupling elements to each other. For a user this combination provides a tactile feedback, which is helpful when coupling the coupling elements to each other. Preferably the combination of the protrusion and the recess is visible for the user.

In a further embodiment of the personal care device according to the invention, said one of the first and second coupling elements comprises a number of protrusions, which are all different from each other, whilst the other of the first and second coupling elements comprises a number of recesses complementary to the protrusions. In this way, the coupling elements can only be coupled to each other in one preferred orientation.

In a further embodiment of the personal care device according to the invention, a position and an inclination of the first and second inclined surfaces is selected such that the first coupling element and the second coupling element arrive from the coupled state into the uncoupled state by rotating the coupled coupling elements with respect to each other about the central axis in either the first or the second rotational direction over an angle smaller than 90°.

In this manner, the risk of damage of the first and second coupling elements during rotation of the coupled coupling elements with respect to each other about the central axis is limited. Since uncoupling of the coupling elements can be established by a mutual rotation of the coupling elements over an angle smaller than 90°, the uncoupling of the coupling elements can easily be performed by the user.

In a further embodiment of the personal care device according to the invention, one of the first and second coupling elements comprises a spring element extending perpendicularly to the central axis for cooperation with a groove extending perpendicularly to the central axis and provided in the other of the first and second coupling elements for releasably retaining the coupling elements when coupled to each other.

The spring element retains the coupling elements in a coupled position by cooperation with the groove. The user may release the coupling elements against the spring force, in particular by driving the coupling elements away from each other in the axial direction, preferably by mutually rotating the coupling elements about the central axis.

The invention also relates to a head structure and base structure for use in such a personal care device like a shaving device, wherein the head structure respectively the base structure comprises a coupling element. The coupling element comprises a first and a second inclined surface for cooperating, respectively, with a first and a second co-operating surface of a coupling element of a base structure respectively the head structure of the personal care device, wherein by rotating the coupled coupling elements with respect to each other in a first rotational direction about a central axis the first inclined surface cooperates with the first co-operating surface thereby driving the coupling elements away from each other in an axial direction extending parallel to the central axis, and wherein by rotating the coupled coupling elements with respect to each other in a second rotational direction about the central axis, opposite to the first rotational direction, the second inclined surface cooperates with the second co-operating surface thereby driving the coupling elements away from each other in said axial direction, wherein the first and second inclined surfaces each include an obtuse angle with a tangential direction extending tangentially to the central axis, and wherein the first and second inclined surfaces are inclined in opposite directions relative to said tangential direction.

It is possible to use such coupling elements for coupling parts of the personal care device like a trimmer, brush or shaving head or coupling such parts in other kind of personal care devices like grooming devices.

BRIEF DESCRIPTION OF THE DRAWINGS

In the drawings, like reference numerals refer to like elements.

DESCRIPTION OF PREFERRED EMBODIMENTS

Figure 1:
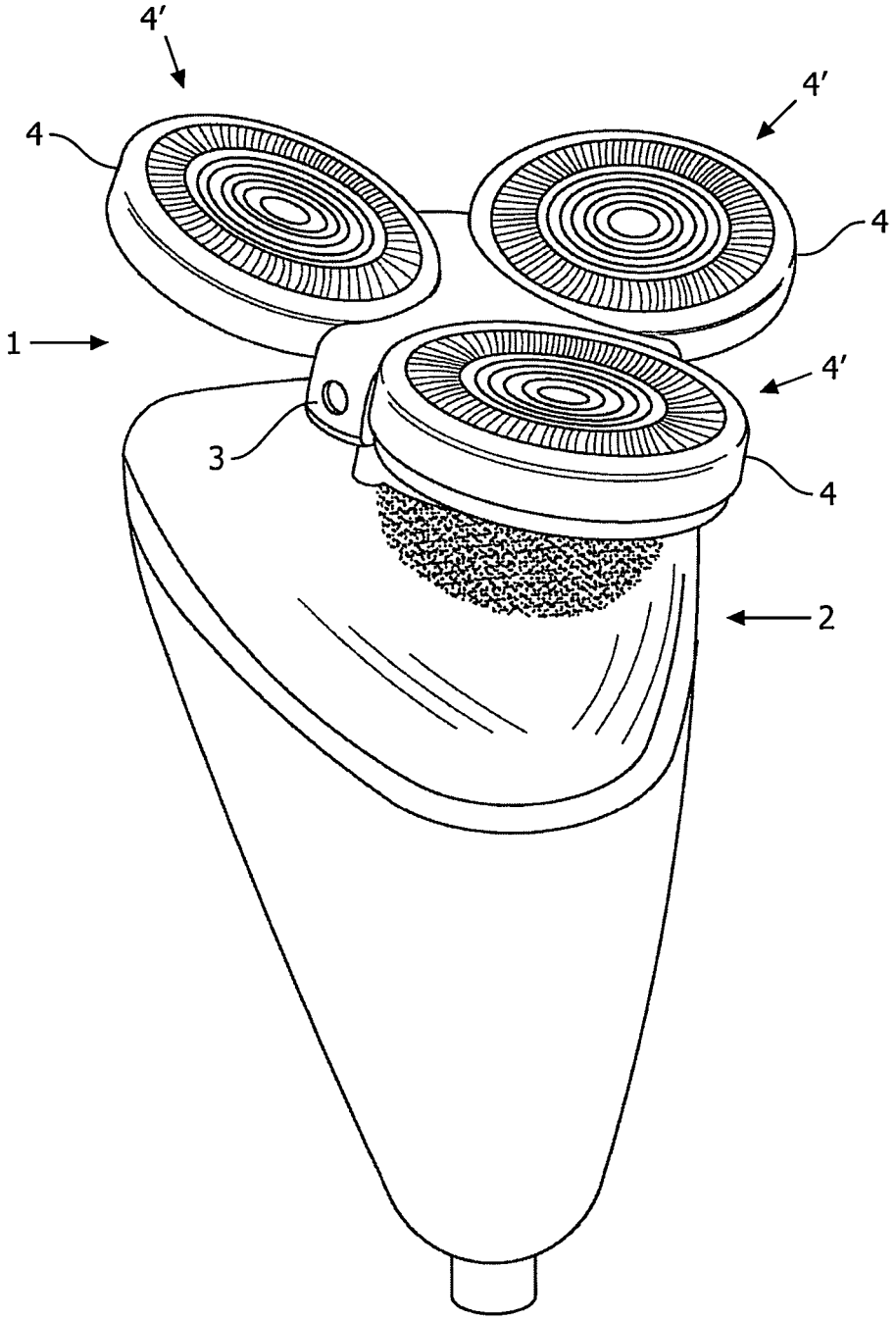
FIG. 1 shows a perspective view of a shaving device according to the invention.
Figure 2:
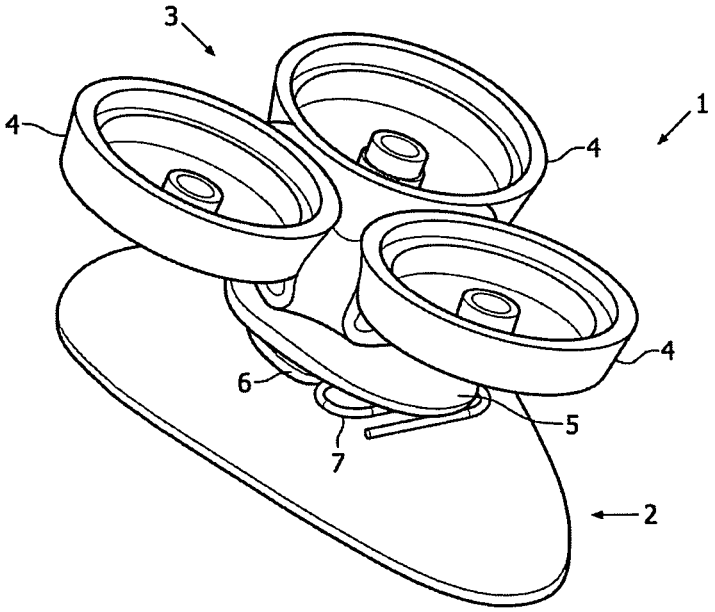
FIG. 2 shows a perspective view of a part of the shaving device as shown in FIG. 1.

FIGS. 1 and 2 show respectively a perspective view of a shaving device 1 and a part thereof as an example of a personal care device according to the invention.

The shaving device 1 comprises a base structure 2 and a head structure 3. The head structure 3 supports and retains three head support structures 4 for rotary shaving heads 4' as an example of a treatment head. The head structure 3 comprises a first coupling element 5, whilst the base structure 2 comprises a second coupling element 6. The first coupling element 5 is partly inserted into the second coupling element 6 and is retained in the second coupling element 6 by means of a spring element 7. Such kind of shaving device 1 is known from EP2086729B1 and will not further be explained.

The shaving device 1 according to the invention differs from the shaving device 1 as described in EP2086729B1, mainly by the design and function of the coupling elements 5, 6.

FIGS. 3A-5B show several views of a first embodiment of two cooperating coupling elements 5, 6 of the shaving device 1 according to the invention.

The first coupling element 5 comprises a tubular part 8 extending along a central axis 9. The tubular part 8 is provided with a ring-shaped collar 10. The ring-shaped collar 10 has a circular part 11 extending over 180 degrees along the central axis 9, straight parts 12, 13 connected to both ends of the circular part 11, and a straight part 14 extending between the straight parts 12, 13. The straight part 14 extends perpendicular to the straight parts 12, 13. The circular part 11 and the straight parts 12, 13, 14 are each provided on its outside with an inclined surface 15. Seen in a plane extending radially with respect to the central axis 9, the inclined surface 15 includes an obtuse angle A (see FIG. 5B) with a plane extending perpendicular to the central axis 9. The obtuse angle A is for example in a range between 95 and 140 degrees. The inclined surfaces 15 are directed towards the second coupling element 6.

Figure 3A:
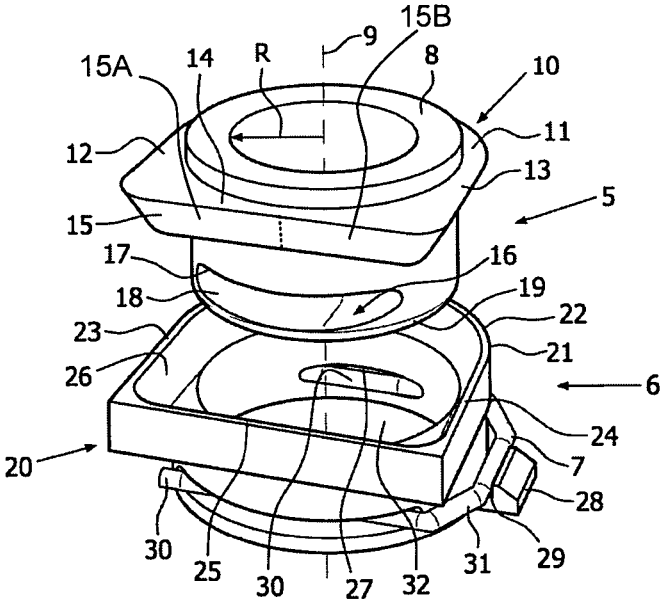
FIG. 3A shows a perspective view of a first embodiment of two cooperating coupling elements according to the invention, in an uncoupled position.
Figure 3B:
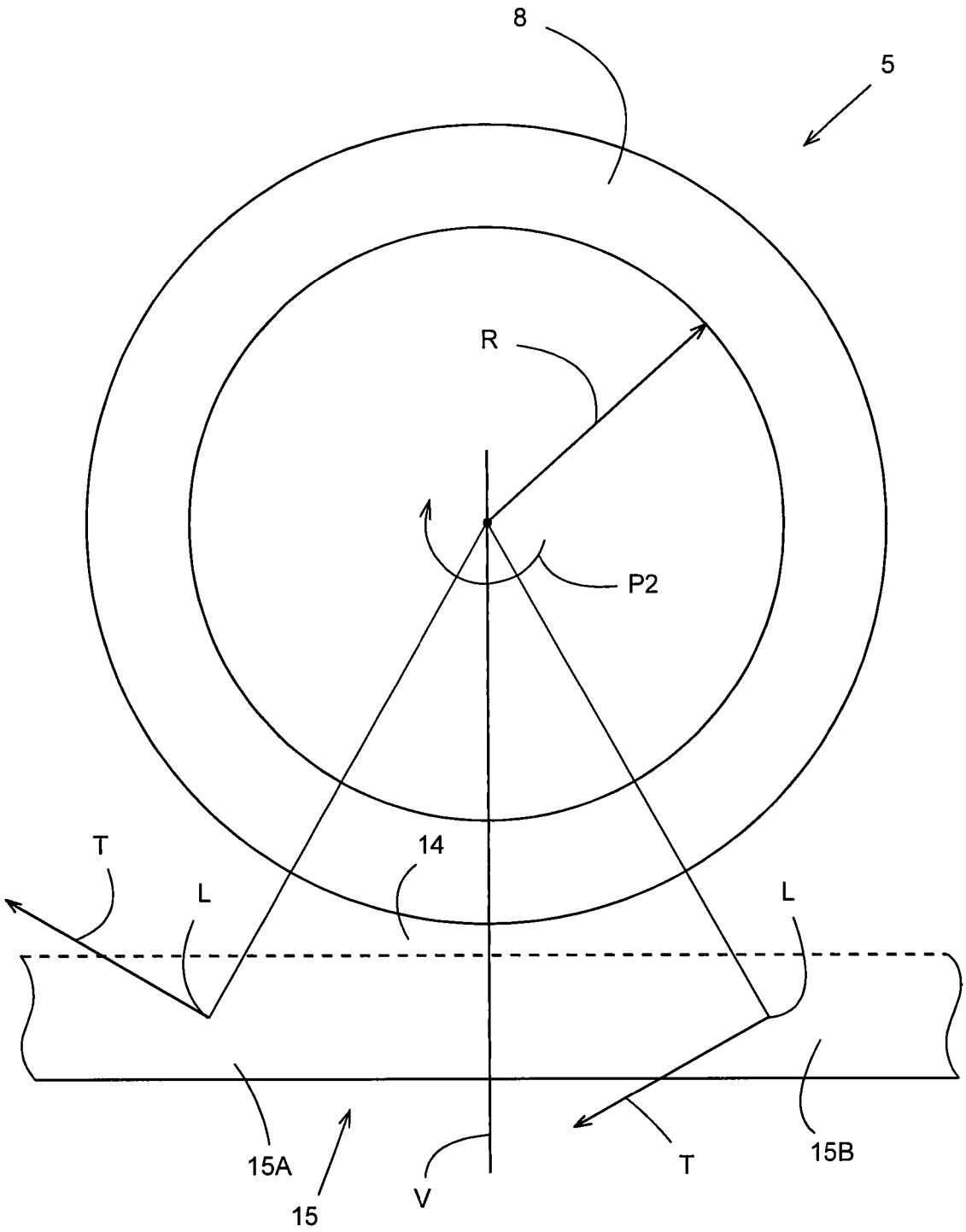
FIG. 3B shows a schematic top view of one of the two cooperating coupling elements as shown in FIG. 3A, FIGS. 4A-4D show perspective views of two coupling elements as shown in FIG. 3, in several steps during coupling of the two coupling elements.

FIG. 3B shows a schematic top view of the first coupling element 5, with the straight part 14 provided with the inclined surface 15. A first inclined surface 15A of the inclined surface 15 is located on a left side whilst a second inclined surface 15B of the inclined surface 15 is located on a right side of a plane V extending radially with respect to the central axis 9 and perpendicularly to the straight part 14.

At each location L on the first and second inclined surface 15A, 15B, a tangential direction T extends perpendicularly to a radial direction between the central axis 9 and the location L. The first inclined surface 15A includes an obtuse angle with the tangential direction T. Since the inclined surface 15 includes an obtuse angle A with a plane extending perpendicularly to the central axis 9 as well as with a radial direction R extending radially to the central axis 9, the obtuse angle of the first inclined surface 15A with the tangential direction T will be different at different locations L on the first inclined surface 15A.

In the same manner, the second inclined surface 15B includes an obtuse angle with the tangential direction T, which will be different at different locations L on the second inclined surface 15B.

As will be clear from FIG. 3B, at each location L on the first inclined surface 15A the obtuse angle between the first inclined surface 15A and the tangential direction T is located on a side of the inclined surface 15 directed towards the central axis 9, whilst at each location L on the second inclined surface 15B the obtuse angle between the second inclined surface 15B and the tangential direction T is located on a side of the inclined surface 15 directed away from the central axis 9. Accordingly the first and second inclined surfaces 15A, 15B are inclined in opposite directions relative to said tangential direction T.

At a distance of the collar 10, the tubular part 8 is provided on its outside with two grooves 16 extending parallel to each other and perpendicular to the central axis 9. One of the grooves 16 extends parallel to the straight part 14. Each groove 16 comprises sloped surfaces 17, 18. An end 19 of the tubular part 8 near the grooves 16 is bevelled.

The second coupling element 6 comprises a tubular part 20 extending along the central axis 9. The internal diameter of the tubular part 20 of the second coupling element 6 is slightly larger than the external diameter of the tubular part of the first coupling element 5. The tubular part 20 is provided with a ring-shaped flange 21. The ring-shaped flange 21 has a circular part 22 extending over 180 degrees along the central axis 9, straight parts 23, 24 connected to both ends of the circular part 22, and a straight part 25 extending between the straight parts 23, 24. The straight part 25 extends perpendicular to the straight parts 23, 24. The circular part 22 and the straight parts 23, 24, 25 are each provided on its inside with an inclined surface 26. Seen in a plane extending radially with respect to the central axis 9, the inclined surface 26 includes an obtuse angle A (see FIG. 5B) with a plane extending perpendicularly to the central axis 9. The inclined surfaces 26 are directed towards the first coupling element 5.

At a distance of the flange 21, the tubular part 20 is provided with two slits 27 extending parallel to each other and perpendicular to the central axis 9. One of the slits 27 extends parallel to the straight part 25.

At an end of the tubular part 20 near the slits 27, the tubular part 20 is provided with a notch 28 and a recess 29 located between the notch 28 and the straight part 24.

A spring element 7 is connected to the second coupling element 6. The spring element 7 is U-shaped and comprises two leg portions 30 extending parallel to each other and a bridge portion 31 extending between the two leg portions 30. The leg portions 30 and bridge portion 31 extend perpendicular to the central axis 9. The leg portions 30 are located in the slits 27 of the tubular part 20 and extend partially through the slits 27 into a cylindrical-shaped space 32 bounded by the tubular part 20.

The bridge portion 31 of the spring element 7 is located in the recess 29 between the notch 28 and the straight part 24.

The coupling and uncoupling of the coupling elements 5, 6 will now be explained with reference to the FIGS. 4A-4D. As will be explained in detail in the following, the first coupling element 5 and the second coupling element 6 are configured to arrive from an uncoupled state into a coupled state relative to each other by driving the first and second coupling elements 5, 6 towards each other in the axial direction along the central axis 9, and to arrive from the coupled state into the uncoupled state by driving the first and second coupling elements 5, 6 away from each other in the axial direction along the central axis 9.

Figure 4A:
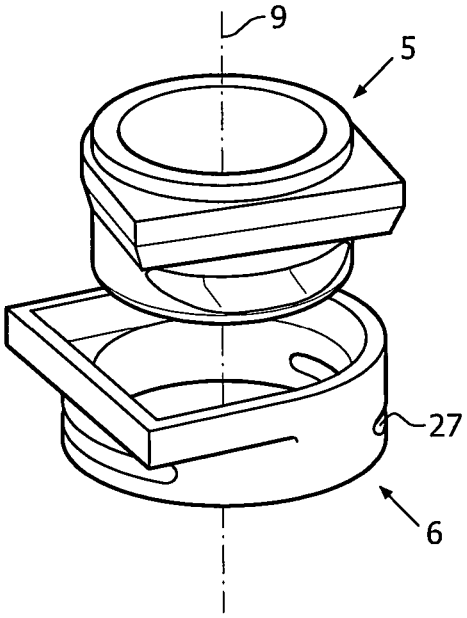
Figure 4B:
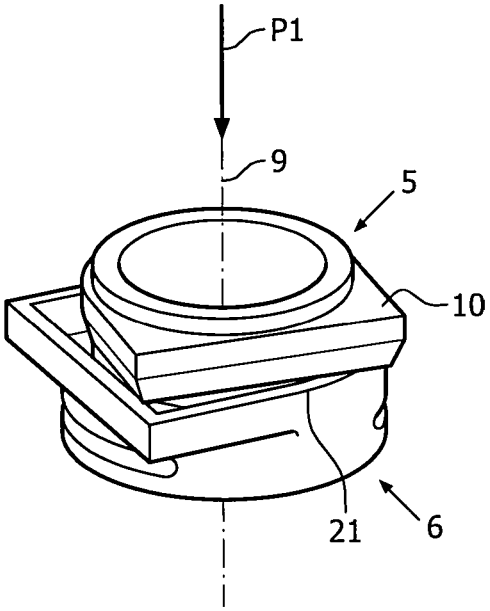
Figure 4C:
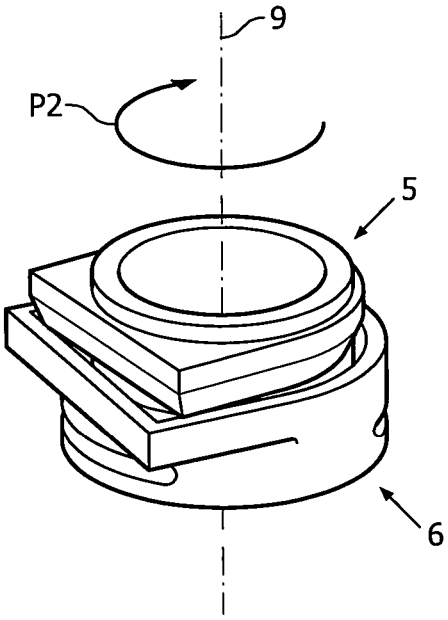
Figure 4D:
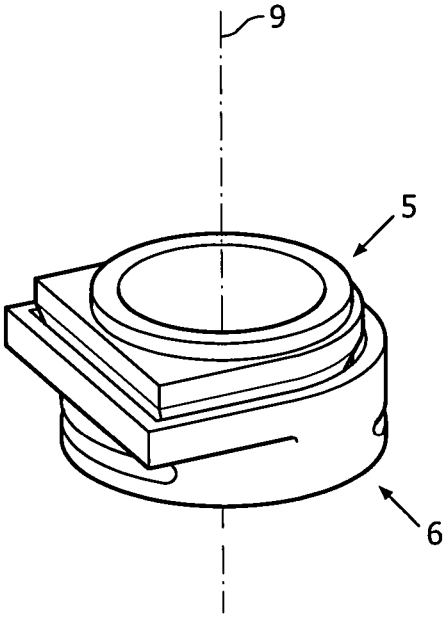
Figure 5A:
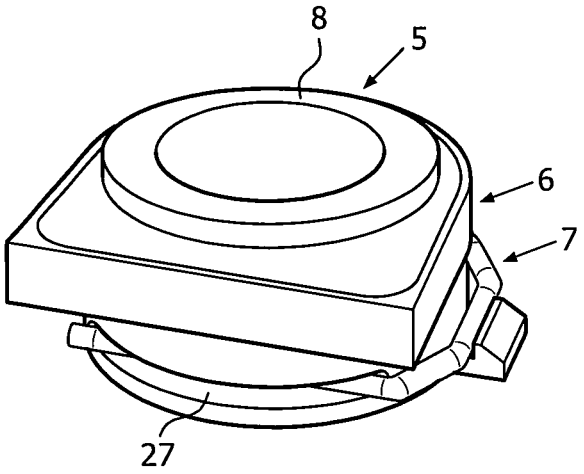
FIGS. 5A and 5B show a perspective view and a cross section of two coupling elements as shown in FIG. 3, in a coupled position.
Figure 5B:
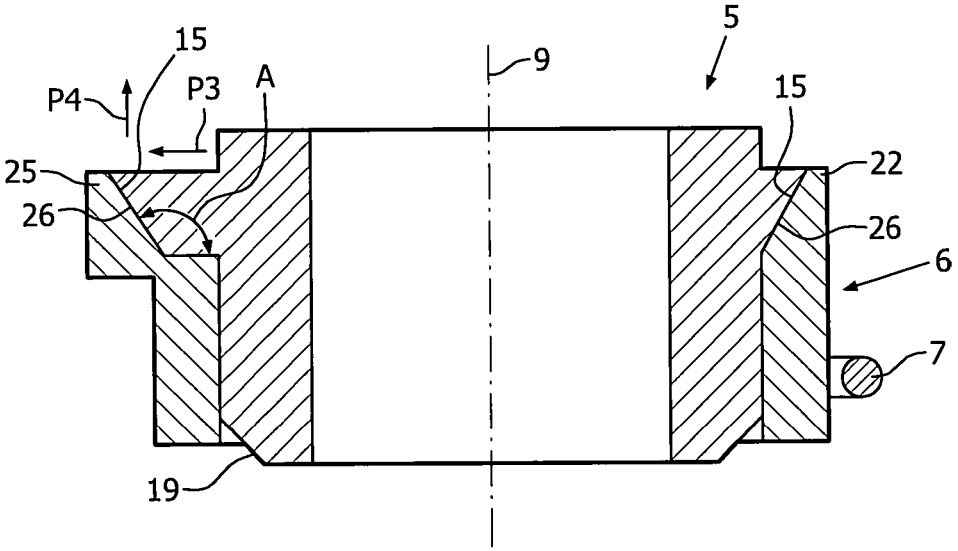

If a user wants to couple the first coupling element 5 of the head structure 3 to the second coupling element 6 of the base structure 2, he will place the first coupling element 5 above the second coupling element 6 and roughly align the central axis 9 of the first coupling element 5 with the central axis 9 of the second coupling element 6 (see FIG. 4A). He will than move the first coupling element 5 in a direction indicated by arrow P1 towards the second coupling element 6, whereby the tubular part 8 is inserted into the cylindrical space 32 bounded by the tubular part 20. The bevelled end 19 facilitates placing by seeking the location of the cylindrical shaped space 32. He will continue until the collar 10 abuts against the flange 21 (see FIG. 4B). The user will rotate the first coupling element 5 in a direction indicated by double arrow P2 along the central axis 9 with respect to the second coupling element 6 (see FIG. 4C). He will continue to rotate the first coupling element 5 until he sees and feels that the circular parts 11, 22, the straight parts 12, 23; 13, 24; 14, 25 are aligned (see FIG. 4D) and the inclined surfaces 15, 26 thereof can be moved further towards each other in the direction indicated by arrow P1 until the inclined surfaces 15, 26 are in abutment. During the movement in the direction indicated by arrow P1, the bevelled end 19 of the first coupling element 5 will force the leg portions 30 of the spring element 7 apart. The leg portions 30 of the spring element 7 will snap into the grooves 16 of the tubular part 8 as soon as the tubular part 8 as moved far enough into the tubular part 20. The spring element 7 retains the first and second coupling elements 5, 6 in the coupled position. This coupled position is shown in FIGS. 5A and 5B.

If a relatively large pulling force is exerted on the head structure 3 in an axial direction parallel to the central axis 9, the leg portions 30 of the spring element 7 will slide along the sloped surface 18 of the groove 16 and will be moved out of the groove 16 and the first coupling element 5 can easily be moved out of engagement with the second coupling element 6.

If a torque is exerted between the head structure 3 and the base structure 2, in for example a clockwise direction indicated by double arrow P2, the inclined surface 15 of the straight part 14 will be forced in a direction indicated by arrow P3 against the co-operating inclined surface 26 of the straight part 25. Due to this force, the inclined surface 15 will be moved in a direction indicated by arrow P4, extending parallel to the central axis 9 and away from the second coupling element 6. The same cooperation will occur between the other inclined surfaces 15, 26. During this movement, the spring element 7 will be disengaged from the grooves 16 in the same manner as described above. The first coupling element 5 will be driven by the cooperating inclined surfaces 15, 26 in the direction indicated by arrow P4, until the coupling elements 5, 6 are in the position as shown in FIG. 4C, in which the coupling elements 5, 6 are freely rotatable with respect to each other. Due to the uncoupling of the coupling elements 5, 6 under influence of the torque, no damage will occur on the head structure 3 and the base structure 2. To prevent damage of the coupling elements 5, 6 as a result of said torque, an inclination of the inclined surface 15, i.e. the obtuse angle A, is selected such that the first coupling element 5 and the second coupling element 6 arrive from the coupled state into the uncoupled state by rotating the coupled coupling elements 5, 6 with respect to each other about the central axis over an angle smaller than 90°, preferably smaller than 45°, and more preferably smaller than 30°.

It is noted that, instead of the first and second coupling elements 5, 6 comprising the spring element 7 and the slits 27 as described here before, other types of coupling elements may be used which are configured to arrive from an uncoupled state into a coupled state relative to each other by driving the coupling elements towards each other in the axial direction along the central axis, and to arrive from the coupled state into the uncoupled state by driving the coupling elements away from each other in the axial direction along the central axis. Examples of such alternative coupling elements are snap connections and snap couplings which are well known to the skilled person.

Figure 6:
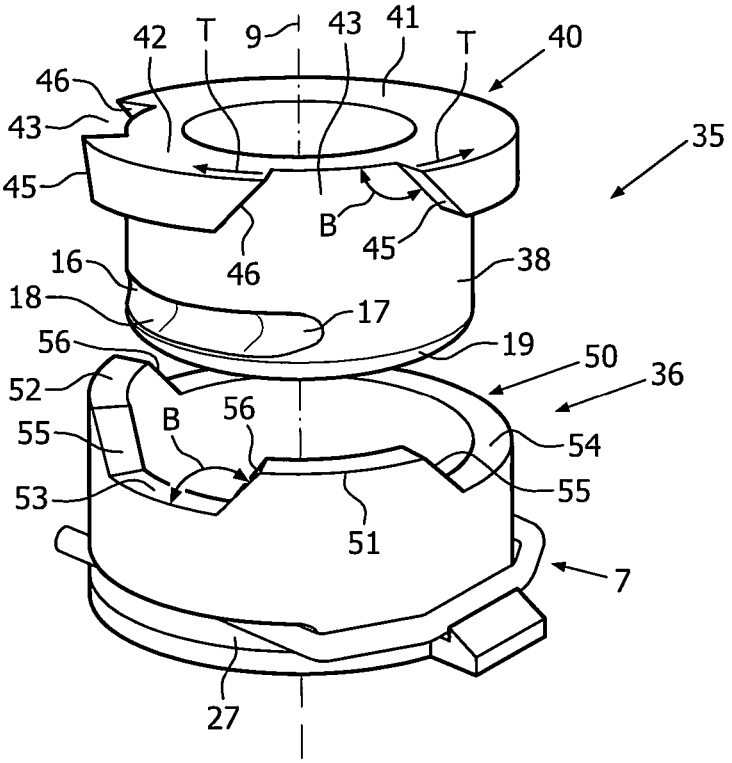
FIG. 6 shows a perspective view of a second embodiment of two cooperating coupling elements according to the invention, in an uncoupled position.
Figure 7A:
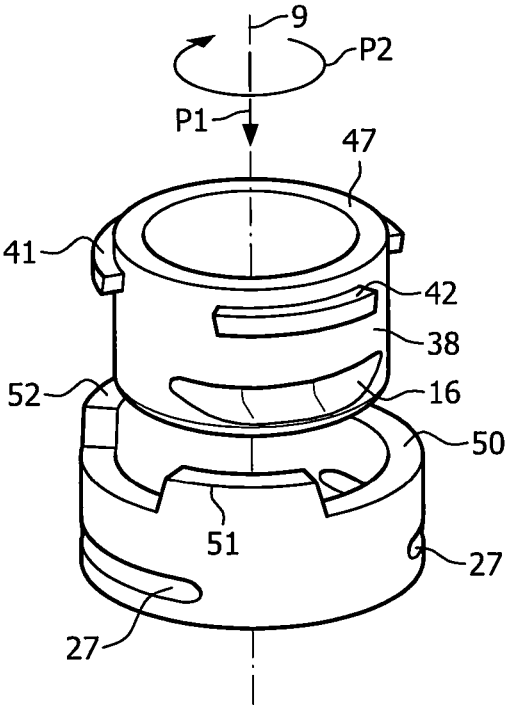
FIGS. 7A-7B show perspective views of two coupling elements as shown in FIG. 6, in two steps during coupling of the two coupling elements.
Figure 7B:
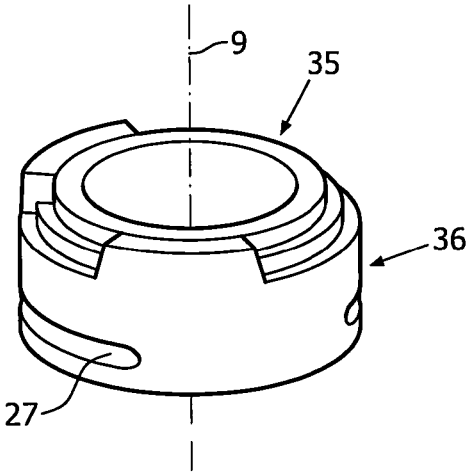
Figure 8:
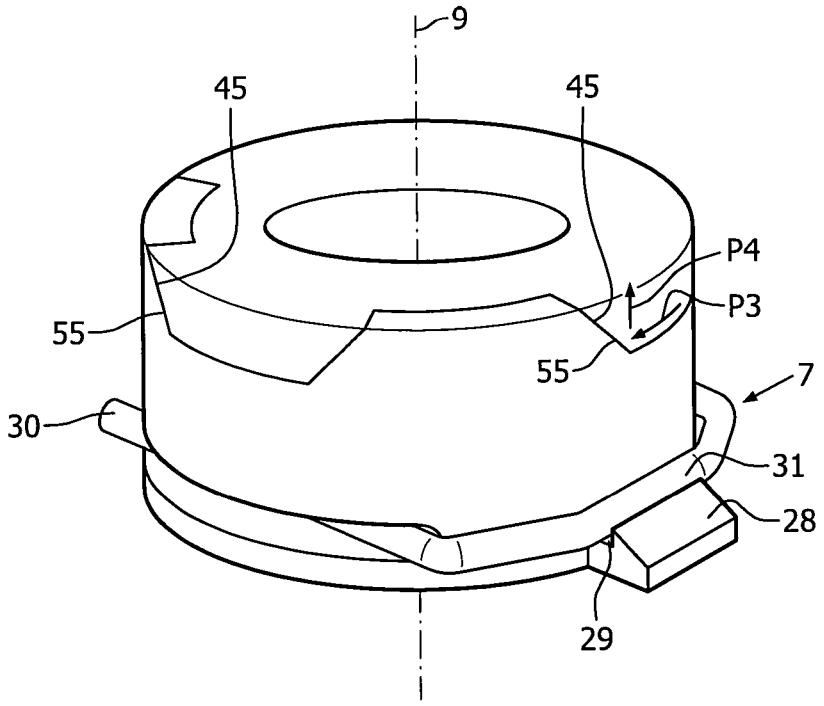
FIG. 8 shows a perspective view of two coupling elements as shown in FIG. 6, in a coupled position.

FIGS. 6-8 show several views of a second embodiment of two cooperating coupling elements 35, 36 of the shaving device 1 according to the invention.

The first coupling element 35 comprises a tubular part 38 extending along a central axis 9. The tubular part 38 is provided with a collar 40. The collar 40 comprises a first circular part 41 extending over about 180 degrees along the central axis 9 and a second circular part 42 extending over about 60 degrees along the central axis 9. The first and second circular parts 41, 42 are separated by open spaces 43 extending over about 60 degrees along the central axis 9. On both ends of the first and second circular parts 41, 42 near the open spaces 43, the first and second circular parts 41, 42 are provided with an inclined surface 45, 46. The inclined surface 45, 46 includes an obtuse angle B (see FIG. 6) with a top side 47 of the collar 40. The top side 47 extends perpendicular to the central axis 9. Furthermore, the inclined surface 45, 46 includes the obtuse angle B with a tangential direction T extending tangential to the central axis 9 and from the respective inclined surface 45, 46. The obtuse angle B is for example in a range between 95 and d 140 degrees. The inclined surface 45, 46 are inclined in opposite directions. The inclined surfaces 45, 46 are directed towards the second coupling element 36.

At a distance of the collar 40, the tubular part 38 is provided on its outside with two grooves 16 extending parallel to each other and perpendicular to the central axis 9. Each groove 16 comprises sloped surfaces 17, 18.

An end 19 of the tubular part 38 near the grooves 16 is bevelled.

The second coupling element 36 comprises a tubular part 50 extending along the central axis 9. The internal diameter of the tubular part 50 of the second coupling element 36 is slightly larger than the external diameter of the tubular part 38 of the first coupling element 35. The tubular part 50 is provided with a first flange 51 and a second flange 52, each extending over about 60 degrees along the central axis 9. The first and second flanges 51, 52 are separated by open spaces 53, 54. The open space 53 extends over about 60 degrees along the central axis 9, whilst the open space 54 extends over about 180 degrees along the central axis 9.

On both ends of the first and second flanges 51, 52 near the open spaces 53, 54 the first and second flanges 51, 52 are provided with an inclined surface 55, 56. The inclined surface 55, 56 includes an obtuse angle B (see FIG. 6) with a plane perpendicular to the central axis 9. Furthermore, the inclined surface 55, 56 includes the obtuse angle B with a tangential direction T extending tangential to the central axis 9 and from the respective inclined surface 55, 56. The inclined surface 55, 56 are inclined in opposite directions. The inclined surfaces 45, 46 are directed towards the first coupling element 35.

The dimensions of the first and second circular parts 41, 42 and the spaces 43 of the first coupling element 35 and the first and second flanges 51, 52 of the second coupling element 36 are such that they match with each other as can be seen in the FIGS. 7B and 8.

The coupling and uncoupling of the coupling elements 35, 36 will now be explained with reference to the FIGS. 7A and 7B. As will be explained in detail in the following, the first coupling element 35 and the second coupling element 36 are configured to arrive from an uncoupled state into a coupled state relative to each other by driving the first and second coupling elements 35, 36 towards each other in the axial direction along the central axis 9, and to arrive from the coupled state into the uncoupled state by driving the first and second coupling elements 5, 6 away from each other in the axial direction along the central axis 9.

If a user wants to couple the first coupling element 35 of the head structure 3 to the second coupling element 36 of the base structure 2, he will place the first coupling element 35 above the second coupling element 36 and will roughly align the central axis 9 of the first coupling element 35 with the central axis 9 of the second coupling element 36 (see FIG. 7A). He will than move the first coupling element 35 in a direction indicated by arrow P1 towards the second coupling element 36 whereby the tubular part 38 is inserted into the tubular part 50. He will continue until the collar 40 abuts against the flanges 51, 52. The user will then rotate the first coupling element 35 in a direction indicated by double arrow P2 along the central axis 9 with respect to the second coupling element 36. He will continue to rotate the first coupling element 35 until he sees and feels that the circular parts 41, 42 are aligned with the flanges 51, 52. The inclined surfaces 45, 46; 55, 56 can then be moved further towards each other in the direction indicated by arrow P1 until the inclined surfaces 45, 55; 46, 56 are in abutment. During the movement in the direction indicated by arrow P1, the bevelled end 19 of the first coupling element 35 will force the leg portions 30 of the spring element 7 apart. The leg portions 30 of the spring element 7 will snap into the grooves 16 of the tubular part 38 as soon as the tubular part 8 as moved far enough into the tubular part 50. The spring element 7 retains the first and second coupling elements 35, 36 in the coupled position. This coupled position is shown in FIGS. 7B and 8.

If a relatively large pulling force is exerted on the head structure 3 in an axial direction parallel to the central axis 9, the leg portions 30 of the spring element 7 will slide along the sloped surface 18 of the groove 16 and will be moved out of the groove 16 and the first coupling element 35 can easily be moved out of engagement with the second coupling element 36.

If a relatively large torque is exerted between the head structure 3 and the base structure 2, in for example a clockwise direction indicated by double arrow P2, the inclined surfaces 45 of the part 41, 42 will be forced in a direction indicated by arrow P3 against the co-operating inclined surface 55 of the flanges 51, 52. Due to this force, the inclined surfaces 45 will be moved in a direction indicated by arrow P4, extending parallel to the central axis 9 and away from the second coupling element 36. During this movement, the spring element 7 will be disengaged from the grooves 16 in the same manner as described above. The first coupling element 35 will be driven by the cooperating inclined surfaces 45; 55 in the direction indicated by arrow P4, until the coupling elements 35, 36 are in the position in which the coupling elements 35, 36 are freely rotatable with respect to each other. Due to the uncoupling of the coupling elements 35, 36 under influence of the torque, no damage will occur on the head structure 3 and the base structure 2. To prevent damage of the coupling elements 35, 36 as a result of said torque, an inclination of the inclined surfaces 45, 46, i.e. the obtuse angle B, is selected such that the first coupling element 35 and the second coupling element 36 arrive from the coupled state into the uncoupled state by rotating the coupled coupling elements 35, 36 with respect to each other about the central axis 9 over an angle smaller than 15°, and more preferably smaller than 10°.

In case that a torque is applied in a counter-clockwise direction, the inclined surfaces 46 will slide along the inclined surfaces 56.

The obtuse angle between the first inclined surface with the tangential direction T might be the same or different from the obtuse angle between the second inclined surface with the tangential direction T.

If a user wants to uncouple the coupling elements, he may apply a pulling force in axial direction at one coupling element to disengage the spring 7 from the groove 27 or he may apply a relatively large torque about the central axis 9. He can also apply such a pulling force as well as such a torque.

Due to the specific shape of the collars 10, 40 and the ring-shaped flange 21 respectively the flanges 51, 52, the first and second coupling elements 5, 6; 35, 36 can be connected to each other in only one specific orientation with respect to each other. For a user this specific orientation is clearly visible and the user will get tactile feedback when connecting the coupling elements to each other.

The flanges and circular parts form protrusions, which fit in recesses formed by the spaces between the flanges and the circular parts, wherein the coupling elements can only be coupled to each other if each protrusion is located in the correct recess.

It is also possible that due to the shape, dimensions and locations of the protrusions and recesses the coupling elements can be coupled to each other in two or more different orientations with respect to each other, wherein in each orientation the coupling elements are correctly coupled to each other.

It is possible to use the coupling elements for coupling parts of a personal care device of another type than the shaving device described here before, for example a trimmer, brush or shaving head, or for coupling parts in such kind of personal care devices like grooming devices.

The person skilled in the art will realize that the present invention is by no means limited to the preferred embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the scope should not be construed as limiting the scope of the claims.

LIST OF REFERENCE SIGNS

1 shaving device
2 base structure
3 head structure
4 head support structure
4' rotary shaving head
5 first coupling element
6 second coupling element
7 spring element
8 tubular part
9 central axis
10 ring-shaped collar
11 circular part
12 straight part
13 straight part
14 straight part
15 inclined surface
15A first inclined surface
15B second inclined surface
16 groove
17 sloped surface
18 sloped surface
19 end
20 tubular part
21 ring-shaped flange
22 circular part
23 straight part
24 straight part
25 straight part
26 inclined surface
27 slit
28 notch
29 recess
30 leg portion
31 bridge portion
32 cylindrical-shaped space
35 first coupling element
36 second coupling element
38 tubular part
40 collar
41 first circular part
42 second circular part
43 open space
45 inclined surface
46 inclined surface
47 top side
50 tubular part
51 first flange
52 second flange
53 open space
54 open space
55 inclined surface
56 inclined surface
A angle
B angle
L locations
P1 arrow
P2 arrow
P3 arrow
P4 arrow
R radial direction
T tangential direction
V plane

The invention claimed is:

1. A personal care device comprising:

a head structure comprising a first coupling element and at least a head support structure configured to hold at least one treatment head, a base structure comprising a second coupling element, wherein the first and second coupling elements can be releasably coupled to each other for coupling the head structure to the base structure, the first coupling element of the head structure comprising:

(i) a tubular part extending along a central axis, the tubular part being provided with a ring-shaped collar, the ring-shaped collar having a circular part extending over 180 degrees along the central axis, (ii) a first straight part and a second straight part connected to respective ends of the circular part, and (iii) a third straight part extending between the first and second straight parts, the third straight part being perpendicular to the first and second straight parts, wherein the circular part, the first straight part, the second straight part, and the third straight part of the first coupling element are each provided with a respective inclined external surface as seen in a plane extending radially with respect to the central axis, directed towards the second coupling element, and wherein the inclined external surface of the third straight part is comprised of a first inclined external surface and a second inclined external surface, the first inclined external surface being located on a left side of a plane (V) extending radially with respect to the central axis and perpendicularly with respect to the third straight part, and the second inclined external surface being located on a right side of the plane (V) extending radially with respect to the central axis and perpendicularly with respect to the third straight part, the second coupling element of the base structure comprising:

(i) a tubular part extending along the central axis, wherein an internal diameter of the tubular part of the second coupling element is slightly larger than the external diameter of the tubular part of the first coupling element, wherein the tubular part is provided with a ring-shaped flange having a circular part extending over 180 degrees along the central axis, (ii) a first straight part, a second straight part and a third straight part, whereby the first and second straight parts are connected to respective ends of the circular part, wherein the circular part, the first straight part, the second straight part and the third straight part of the second coupling element are each provided on its inside with an internal inclined surface as seen in a plane extending radially with respect to the central axis, wherein the inclined surfaces on each of the first and second coupling elements are inclined in opposite directions relative to a tangential direction extending tangentially to the central axis, wherein at least one external inclined surface of the first coupling element of the head structure is configured to cooperate with at least one corresponding cooperating internal inclined surface of the second coupling element of the base structure, wherein the respective inclined surfaces of the second coupling element are directed towards the first coupling element of the head structure, wherein by rotating the first and second coupling elements with respect to each other in a first rotational direction about the central axis, the first external inclined surface of the third straight part of the first coupling element of the head structure cooperates with a first co-operating internal inclined surface of the second coupling element of the base structure thereby driving the first and second coupling elements away from each other in an axial direction extending parallel to the central axis, and wherein by rotating the coupling elements with respect to each other in a second rotational direction about the central axis, opposite to the first rotational direction, the second external inclined surface of the third straight part of the first coupling element of the head structure cooperates with a second co-operating internal inclined surface of the second coupling element of the base structure thereby driving the first and second coupling elements away from each other in said axial direction.

2. A personal care device according to claim 1, wherein the first and second co-operating surfaces of the second coupling element that cooperate with the first and second inclined surfaces of the first coupling element are also inclined.

3. A personal care device according to claim 2, wherein the first and second inclined surfaces and the first and second co-operating surfaces have corresponding inclinations.

4. A personal care device according to claim 1, wherein the first and second inclined surfaces are straight longitudinal surfaces extending tangentially with respect to a longitudinal reference plane extending in a reference radial direction to the central axis.

5. A personal care device according to claim 1, wherein the head structure, when coupled to the base structure, is solely supported by the coupling elements.

6. A personal care device according to claim 1, wherein the first coupling element and the second coupling element are configured to arrive from an uncoupled state into a coupled state relative to each other by driving the first and second coupling elements towards each other in a coupling direction opposite to the axial direction, and to arrive from the coupled state into the uncoupled state by driving the first and second coupling elements away from each other in the axial direction.

7. A personal care device according to claim 6, wherein the first and second inclined surfaces are inclined with respect to said plane extending perpendicularly with respect to the central axis such that the first coupling element and the second coupling element arrive from the coupled state into the uncoupled state by rotating the coupled coupling elements with respect to each other about the central axis in either the first or the second rotational direction over an angle smaller than 90°.

8. A personal care device according to claim 6, wherein one of the first and second coupling elements comprises a spring element extending perpendicularly to the central axis for cooperation with a groove extending perpendicularly to the central axis and provided in the other of the first and second coupling elements for releasably retaining the coupling elements when coupled to each other.

9. A personal care device according to claim 1, wherein the first and second inclined surfaces of the first coupling element each include an obtuse angle with a tangential direction extending tangentially to the central axis, wherein the obtuse angle is between 95 and 140 degrees.

10. A personal care device according to claim 9, wherein a size of the obtuse angle partially determines a relation between an amount of torque applied in one of a clockwise or counterclockwise direction to move the coupling elements away from each other and a corresponding displacement in the axial direction.

11. A head structure in a personal care device having a coupling element for use in coupling to a base structure having a corresponding coupling element, the head structure configured to hold at least one treatment head, the coupling element of the head structure comprising:

(i) a tubular part extending along a central axis, the tubular part being provided with a ring-shaped collar, the ring-shaped collar having a circular part extending over 180 degrees along the central axis, (ii) a first straight part and a second straight part connected to respective ends of the circular part, and (iii) a third straight part extending between the first and second straight parts, the third straight part being perpendicular to the first and second straight parts, wherein the circular part, the first straight part, the second straight part, and the third straight part of the first coupling element are each provided with an inclined external surface as seen in a plane extending radially with respect to the central axis, directed towards the corresponding coupling element of the base structure, wherein the inclined external surface of the third straight part is comprised of a first inclined external surface and a second inclined external surface, the first inclined external surface being located on a left side of a plane (V) extending radially with respect to the central axis and perpendicularly with respect to the third straight part, and the second inclined external surface being located on a right side of the plane (V) extending radially with respect to the central axis and perpendicularly with respect to the third straight part.

12. A head structure according to claim 11, wherein the first and second inclined surfaces of the first coupling element each include an obtuse angle with a tangential direction extending tangentially to the central axis, wherein the obtuse angle is between 95 and 140 degrees.

13. A head structure according to claim 12, wherein a size of the obtuse angle partially determines a relation between an amount of torque applied in one of a clockwise or counterclockwise direction to move the coupling elements away from each other and a corresponding displacement in the axial direction.

14. A base structure for use in coupling to a head structure having a corresponding coupling element in a personal care device, the base structure comprising a coupling element and a spring element, the coupling element of the base structure comprising:

(i) a tubular part extending along the central axis, wherein the tubular part is provided with a ring-shaped flange having a circular part extending over 180 degrees along the central axis, (ii) a first straight part, a second straight part and a third straight part, whereby the first and second straight parts are connected to respective ends of the circular part, wherein the third straight part extends between the first and second straight parts and is perpendicular to the first and second straight parts, wherein the circular part, the first straight part, the second straight part and the third straight part of the base structure are each provided with a respective inclined internal surface as seen in a plane extending radially with respect to the central axis, directed towards the corresponding coupling element of the head structure, wherein the at least one inclined external surface of the coupling element of the base structure is configured to cooperate with at least one corresponding cooperating inclined external surface of the corresponding coupling element of the head structure, wherein the inclined internal surface of the third straight part of the base structure is comprised of a first inclined internal surface and a second inclined internal surface, the first inclined internal surface being located on a left side of the plane extending radially with respect to the central axis and perpendicularly with respect to the third straight part, and the second inclined internal surface being located on a right side of the plane extending radially with respect to the central axis and perpendicularly with respect to the third straight part, wherein the inclined surfaces of the coupling element of the base structure are inclined in an opposite direction to the corresponding coupling element of the head structure relative to a tangential direction extending tangentially to the central axis, wherein by rotating the coupling element of the base structure with respect to the corresponding coupling element of the head structure in a first rotational direction about the central axis, the first inclined internal surface of the third straight part of the coupling element of the base structure cooperates with a corresponding first inclined external co-operating surface of the coupling element of the head structure thereby driving the coupling element of the base structure away from the coupling element of the head structure in an axial direction extending parallel to the central axis, and wherein by rotating the coupling element of the base structure with respect to the corresponding coupling element of the head structure in a second rotational direction about the central axis, opposite to the first rotational direction, the second inclined internal surface of the third straight part of the coupling element of the base structure cooperates with a corresponding second inclined external co-operating surface of the coupling element of the head structure thereby driving the first and second coupling elements away from each other in said axial direction.

15. A base structure according to claim 14, wherein the first and second inclined surfaces of the first coupling element each include an obtuse angle with a tangential direction extending tangentially to the central axis, wherein the obtuse angle is between 95 and 140 degrees.

16. A base structure according to claim 15, wherein a size of the obtuse angle partially determines a relation between an amount of torque applied in one of a clockwise or counterclockwise direction to move the coupling elements away from each other and a corresponding displacement in the axial direction.

17. A coupling structure comprising at least a first coupling element and a second coupling element, wherein the coupling elements can be releasably coupled to each other, the first coupling element of the coupling structure comprising:

(iv) a tubular part extending along a central axis, the tubular part being provided with a ring-shaped collar, the ring-shaped collar having a circular part extending over 180 degrees along the central axis, (v) a first straight part and a second straight part connected to respective ends of the circular part, and (vi) a third straight part extending between the first and second straight parts, the third straight part being perpendicular to the first and second straight parts, wherein the circular part, the first straight part, the second straight part, and the third straight part of the first coupling element are each provided with an inclined external surface as seen in a plane extending radially with respect to the central axis, directed towards the second coupling element, wherein the inclined external surface of the third straight part is comprised of a first inclined external surface and a second inclined external surface, the first inclined external surface being located on a left side of a plane (V) extending radially with respect to the central axis and perpendicularly with respect to the third straight part, and the second inclined external surface being located on a right side of the plane (V) extending radially with respect to the central axis and perpendicularly with respect to the third straight part, the second coupling element of the coupling structure comprising:

(iii) a tubular part extending along the central axis, wherein an internal diameter of the tubular part of the second coupling element is slightly larger than the external diameter of the tubular part of the first coupling element, wherein the tubular part is provided with a ring-shaped flange having a circular part extending over 180 degrees along the central axis, (iv) a first straight part, a second straight part and a third straight part, whereby the first and second straight parts are connected to respective ends of the circular part, wherein the third straight part of the second coupling element extends between the first and second straight parts and is perpendicular to the first and second straight parts, wherein the circular part, the first straight part, the second straight part and the third straight part of the second coupling element are each provided on its inside with an inclined surface as seen in a plane extending radially with respect to the central axis, wherein the respective corresponding inclined surfaces on each of the first and second coupling elements are inclined in opposite directions relative to a tangential direction extending tangentially to the central axis, wherein the respective inclined surfaces of the second coupling element are directed towards the first coupling element of the coupling structure, wherein the coupling element of the second coupling element comprises a first co-operating surface configured to co-operate with the first inclined surface of the third straight part, wherein the coupling element of the second coupling element comprises a second co-operating surface configured to co-operate with the second inclined surface of the third straight part, wherein at least one inclined external surface of the second coupling element of the coupling structure is configured to cooperate with at least one corresponding cooperating inclined external surface of the corresponding first coupling element of the coupling structure, wherein by rotating the first and second coupling elements with respect to each other in a first rotational direction about the central axis, the first inclined surface of the third straight part of the first coupling element cooperates with a corresponding first co-operating portion of the inclined internal surface of the second coupling element thereby driving the first and second coupling elements away from each other in an axial direction extending parallel to the central axis, and wherein by rotating the first and second coupling elements with respect to each other in a second rotational direction about the central axis, opposite to the first rotational direction, the second inclined external surface of the third straight part of the first coupling element cooperates with a corresponding the second co-operating portion of inclined internal surface of the second coupling element thereby driving the first and second coupling elements away from each other in said axial direction.

18. A coupling structure according to claim 17, wherein the first and second inclined surfaces of the first coupling element each include an obtuse angle with a tangential direction extending tangentially to the central axis, wherein the obtuse angle is between 95 and 140 degrees.

19. A coupling structure according to claim 18, wherein a size of the obtuse angle partially determines a relation between an amount of torque applied in one of a clockwise or counterclockwise direction to move the coupling elements away from each other and a corresponding displacement in the axial direction.

* * * * *